US012378644B2

(12) United States Patent
Cinca I Luis et al.

(10) Patent No.: US 12,378,644 B2
(45) Date of Patent: Aug. 5, 2025

(54) HARD METAL CEMENTED CARBIDE

(71) Applicant: HYPERION MATERIALS & TECHNOLOGIES, INC., Worthington, OH (US)

(72) Inventors: Nuria Cinca I Luis, Barcelona (ES); Laura Larrimbe, Barcelona (ES); Jose Maria Tarrago, Lindau (DE)

(73) Assignee: HYPERION MATERIALS & TECHNOLOGIES, INC., Worthington, OH (US)

( * ) Notice: Subject to any disclaimer, the term of this patent is extended or adjusted under 35 U.S.C. 154(b) by 228 days.

(21) Appl. No.: 17/430,996

(22) PCT Filed: Feb. 14, 2020

(86) PCT No.: PCT/EP2020/053980

§ 371 (c)(1),
(2) Date: Aug. 13, 2021

(87) PCT Pub. No.: WO2020/169488

PCT Pub. Date: Aug. 27, 2020

(65) Prior Publication Data

US 2022/0170140 A1 Jun. 2, 2022

(30) Foreign Application Priority Data

Feb. 19, 2019 (GB) ..... 1902272

(51) Int. Cl.

| | |
|---|---|
| ***C22C 29/08*** | (2006.01) |
| ***B21C 3/02*** | (2006.01) |
| ***B22F 3/15*** | (2006.01) |
| ***B22F 5/12*** | (2006.01) |

(52) U.S. Cl.

CPC ..... *C22C 29/08* (2013.01); *B21C 3/02* (2013.01); *B22F 3/15* (2013.01); *B22F 5/12* (2013.01)

(58) Field of Classification Search

CPC ..... C22C 29/08; C22C 1/051; C22C 29/067; B21C 3/02; B22F 3/15; B22F 5/12; B22F 2005/002; B22F 2998/10; B22F 2999/00; B22F 5/10

USPC ..... 75/240

See application file for complete search history.

(56) References Cited

FOREIGN PATENT DOCUMENTS

| | | | | |
|---|---|---|---|---|
| CN | 106756394 | A | 5/2017 | |
| EP | 1726672 | A1 | 11/2006 | |
| JP | 2004315903 | A * | 11/2004 | |
| JP | 2013244589 | A * | 12/2013 | |
| JP | 2017013146 | | 1/2017 | |
| WO | WO2011/058167 | A1 * | 5/2011 | ..... C22C 1/05 |

(Continued)

OTHER PUBLICATIONS

JP-2004315903-A Translation (Year: 2004).*

(Continued)

*Primary Examiner* — Danielle M. Carda
(74) *Attorney, Agent, or Firm* — Ari G. Zytcer

(57) ABSTRACT

A cemented carbide suitable as a high performance hard metal material for wire drawing of high-tensile strength alloys is provided. The cemented carbide may include a relatively low binder content with additives Cr, Ta and/or Nb to provide high wear and corrosion resistance, high thermal conductivity, high hardness and a desired hardness to fracture toughness correlation.

8 Claims, 10 Drawing Sheets

(56) References Cited

FOREIGN PATENT DOCUMENTS

WO 2018113923 A 6/2018

OTHER PUBLICATIONS

Murray et al, Preparation and Characterization of Pure Metals, ASM Handbook, vol. 2 (Year: 1990).*
JP2013244589A Translation (Year: 2013).*
Piotr Siwak et al, "The Effect of Cr3C2 and TaC additives on Microstructure, Hardness and Fracture Toughness of WC-6Co Tool Material Fabricated by Spark Plasma Sintering", Materials Research, vol. 20, No. 3, May 11, 2017, pp. 780-785.
Daniele Mari et al., "Comprehensive Hard materials 1, Daniele Mari, Luis Miguel, Christoph Nebel—Amazon.com", Feb. 1, 2014, Elsevier, pp. 1-1806, p. 438; section 1.15.3.6; grain grown inhibitors.

* cited by examiner (a)

(b)

(a)

(b)

(a)

(b)

(b)

(a)

(a) (b)

Sample D

Sample F

Sample C

Sample E

HARD METAL CEMENTED CARBIDE

This is a National Phase Application filed under 35 U.S.C. 371 as the national stage of PCT/EP2020/053980, filed on Feb. 14, 2020, an application claiming the benefit of Great Britain Patent Application No. 1902272.2, filed on Feb. 19, 2019, the entire content of each of which is hereby incorporated by reference in its entirety.

FIELD OF DISCLOSURE

The present subject matter relates to a cemented carbide having a desired hardness to toughness correlation and exhibiting high thermal conductivity together with high wear and corrosion resistance. The present cemented carbide according to a specific implementations may find use as a wire drawing die for high-tensile strength alloys.

BACKGROUND

Through a combination of a soft and ductile Co-based binder with hard, wear resistant carbide such as WC, cemented carbides display outstanding properties that combine high hardness and moderate toughness at temperatures up to 400° C. Their physical and mechanical characteristics including strength, refractoriness, thermal conductivity, resistance to compressive deformation and wear and corrosion resistance have seen cemented carbides exploited extensively for various high demand applications such as cutting dies, material-deforming tools, structural components, mining bits, press molds, miniature drills for highly integrated printed circuit boards, rock drills, bearings, mechanical seals, and wear parts.

Tool failure in such applications may be triggered by a number of wear mechanisms (e.g. brittle fracture, fatigue, abrasion, attrition and plastic deformation, possibly assisted to various degrees by corrosion and diffusion) which may vary according to service conditions and may occur at macroscopic and/or microscopic levels.

Among metal forming processes, one application in which tools suffer a synergistic effect of wear plus corrosion is wire drawing. During wire drawing (which is a cold working process), material is pulled through a die to reduce its cross section to the desired shape and size. Based upon repeated drawing sequences and intermediate annealing, several forms and sizes of wires can be drawn. The process is a complex interaction of many parameters and a successful wire drawing practice involves careful selection of these. Such parameters can be listed as follows: wire properties (yield strength, elastic modulus, strain hardening exponent), lubricant (friction coefficient, viscosity), die geometry (reduction angle, bearing region length, reduction area, and material) and process parameters (temperature, drawing speed, material surface treatment).

Steel, aluminium and copper are the three metals widely used to produce wires. Steel is a major constituent material for a wide range of market applications and products, such as in the automotive, construction, mining and packaging sectors. In recent years, there has been an increased trend to produce ultra-high strength steel wires. Wear of drawing dies is a fundamental limitation in the wire drawing process. During the drawing process, friction occurs between the wire and the dies. Worn dies result in direct costs, with die replacement and reconditioning time a further cost penalty. Die wear must be detected before substantial quantities of out of size or blemished wire is produced.

Cemented tungsten carbide dies have been used in wire drawing for many years. A combination of strength and wear resistance make this material widely accepted in the steel wire industry, particularly in drawing steel cord filament. Material properties that influence the degree of wear in cemented carbide dies include hardness, thermal conductivity, microstructure and composition, lubrication or lack thereof, as well as the specific operating conditions.

Coarse wire is usually dry drawn by grades with 10 wt % or 6 wt % Co and a hardness 1600 and 1750 Vickers respectively. Wet drawing from 1.5-2 mm down to final dimension, 0.15-0.3 mm, is usually made with drawing dies in grades having a hardness of from about 1900-2000 HV and Co content <6.5 wt %, most often around 3-5 wt %. To reduce the friction during wet drawing, an emulsion lubricant (oil in water) is either sprayed on the wire or used in fully immersed conditions. The process involves various pressure, temperature and speed conditions for different contacts. The most common modes of wear (which may result in failure in dies during use) include fracturing, abrasive wear, attrition wear (sometime called particle pull-out), corrosive wear and galling.

With regard to composition, TaNbC-containing alloys have been demonstrated to have the longest life, although VC-containing alloys have the finest grain size and highest hardness. Also, although nickel may be considered to improve corrosion resistance, cemented carbide grades with Co+Ni as a binder and $Cr_3C_2$ have not exhibited suitable wire drawing properties, indicating that corrosion resistance does not influence directly the results of the wire drawing effectiveness [M. Takada, H. Matsubara, and Y. Kawagishi, "Wear of Cemented Carbide Dies for Steel Cord Wire Drawing," *Mater. Trans., vol.* 54, no. 10, pp. 2011-2017, 2017].

EP 1726672 A1 describes a cemented carbide for steel tire cord drawing comprising WC with an ultra-fine grain size and between 5 to 10 wt % Co. Grain growth inhibitors include V and/or Cr to provide a Vickers hardness HV30 of around 1900.

However, further improvement of existing cemented carbides for high demand applications (for example as metal wire drawing dies) is desired with regard to wear resistance, corrosion resistance, thermal conductivity, hardness and toughness so as to provide the desired quality performance and extend as long as possible operational service lifetimes.

SUMMARY

The present disclosure is directed to a high hardness, high performance material suitable for physically demanding applications such as wire drawing of high-tensile strength alloys. Also provided is a material with high wear and corrosion resistance, high thermal conductivity, high hardness and in particular an enhanced hardness to fracture toughness relationship.

The advantages of the present material are provided in part as the present material has a relatively low binder content and fine grain sizes. Additionally, as hardness and toughness are typically mutually exclusive, an increase in the hardness to toughness relationship is provided further through selective addition of additives including Cr and Ta and/or Nb. The concentrations of such additives are controlled to achieve dissolution in the binder and preferably avoidance of precipitation that would otherwise be detrimental to the desired physical and mechanical characteristics of the material. Grain sizes are selectively controlled to further enhance the desired material properties.

There is provided a cemented carbide comprising: at least 93 wt % WC; Co at 3 to 5 wt %; Cr at 0.1 to 0.5 wt %; Ta and/or Nb present alone or in combination at 0.05 to 0.35 wt %; and V at 0.05 to 0.2 wt %.

Preferably, the cemented carbide comprises a wt %-quotient of Cr/Co is in a range 0.04 to 0.1. Such a configuration provides a carbide material having a relatively low binder content and a Cr concentration that is also minimised to reduce a tendency for Cr to precipitate. This in turn provides a material suitable for suppressing grain growth and minimising or eliminating the precipitation of additional phases relative to the hard phase and binder phase.

Reference within this specification to the 'wt %-quotient' encompasses a ratio a wt % Cr to wt % Co each as a respective wt % fraction of the total weight of the cemented carbide material.

Within this specification, values of grain size are determined by linear intercept.

In order to achieve ultrafine grain sizes and extremely high hardness levels (above 1900 HV30) the present material comprises grain growth inhibitor (GGI) additives. VC is one of the most effective GGIs, and is usually added in hard metals requiring an ultrafine and/or fine grain sizes. However, the inventors have identified that VC, even below the solubility limit, partially embrittles hard metals through precipitation of V-based phases at the WC interfaces which in turn lowers the adhesion strength (holding power of the WC grain) and therefore compromises HV to KIc relations. Consequently, the amount of VC (as compared to the binder content) added to the present grades has been partially decreased or eliminated. However, in order to maintain high hardness and ultrafine average grain sizes, it was required to add other GGIs which, despite being less effective than VC in reducing grain size, still exhibit a relevant effect as grain refiners. The selected elements include Cr (i.e. in higher Cr/Co ratios relative to existing reference grades such as commercial hard metal wire drawing nibs), Ta and/or Nb. These elements have the advantage that: (i) they dissolve in the binder and increase the binder strength and work hardening capacity, (ii) they significantly increase corrosion resistance, (iii) they have a strong grain refining effect that do not compromise the HV to KIc relation. It was an objective to add such components below or around the solubility limit in the binder in order to avoid or minimize the precipitation of additional carbide phases (i.e. in addition to WC and binder phases) that could compromise the strength and toughness of the material. Those phases tend to be hard but brittle. However, the inventors have identified that if such components are small sized (i.e. relatively smaller than the average WC grain size), the carbides are widely distributed within the microstructure and it is suggested are beneficial to improve wear resistance without compromising toughness.

The present cemented carbide comprises preferentially two phases including a hard phase and a binder phase. Preferably, the present material comprises exclusively two phases and is devoid of any further phases such as a gamma phase (cubic carbide or mixed carbide phase). In particular, it is preferred that the components of the material that are added to achieve high hardness and/or toughness levels, work hardening, high corrosion resistance and thermal conductivity are present in solid solution within the binder and do not precipitate as a separate and distinct further phase. Accordingly, Nb, Ta, Cr and/or V are added at respective concentrations to avoid precipitation of a third phase within the final cemented carbide and in particular to avoid the presence of a mixed cubic carbide (gamma) phase.

As detailed herein, carbides of Nb, Cr, Ta and V may be added as starting materials e.g. as respective singular carbides or mixed carbides as available from most suppliers. Such carbides and mixed carbide starting materials are typically regarded as suitable starting materials for cemented carbide manufacturing based on cost and availability. As will be appreciated, carbon from such carbides or mixed carbides may then be present in the hard phase and to some extend the binder phase.

The present cemented carbide is provided specifically with fine grain sizes and relatively low binder content to achieve the high hardness and a desired hardness (HV) to toughness (KIc) ratio. As indicated, this may be achieved, in part, by minimising or avoiding any or high concentrations of the powerful grain refiner VC in addition to the present material comprising Ta, Nb or a combination of Ta and Nb as grain growth inhibitors together with Cr (which is also a contributor to WC grain growth inhibition). Moreover, the addition of such additives representing 'minor' components of the material with regard to wt %, has been found to provide a positive influence on increasing the work hardening of the binder. Importantly, any amounts of Ta, Nb and Cr are controlled to ensure such components dissolve within the metallic matrix (Co) and are not precipitated. Advantageously, during any die drawing process, plastic deformation of the binder is prevented so that there is less binder extrusion and the WC grains are better supported.

The use of high speeds in the wire-drawing process of high-tensile strength cords, in order to meet the demands for increased productivity, has an important effect in increasing the heat generated due to plastic deformation and friction between the wire and the drawing tools. Most of the mechanical energy converts to heat and results in temperature rises of the order of hundreds of degrees. This temperature rise greatly affects lubrication conditions, tool life and the properties of the final product. Although the use of a proper lubrication technique substantially reduces the amount of heat generated during drawing and consequently reduces energy consumption, the higher the thermal conductivity of the wire drawing die material, the better to induce heat dissipation and improve tool life.

In order to dissipate the generated heat, it is beneficial to have a drawing nib with high thermal conductivity. Thermal conductivity increases when diminishing the binder content and/or increasing the grain size. However, fine or ultrafine grain sizes are required if the hardness and wear resistance are to be enhanced. Accordingly, the present developed grades combine relatively low binder contents (between 3 wt % to 5 wt %), and fine or ultrafine grain sizes (below 0.8 μm) in order to successfully combine high hardness and wear resistance, high hardness to KIc relations and a moderate or high thermal conductivity (over 50 W/mK, preferably over 60 W/mK, preferably over 70 W/mK).

The inventors provide a cemented carbide hard metal that is suitable, in one application, as nibs for drawing high-strength steel that combines high hardness level (over 1900 HV30, preferably over 1950 HV30, preferably over 2000 HV30), a moderate to high fracture toughness (KIc) level (over 8 $MPa \times m^{1/2}$, preferably over 8.3 $MPa \times m^{1/2}$, preferably over 8.5 $MPa \times m^{1/2}$) an improved hardness to fracture toughness relation, high corrosion resistance, high thermal conductivity, strong WC/WC and WC/binder interfaces and enhanced binder strength and work hardening rates. The present material grades combine the above-mentioned properties through a microstructural design consisting in a hard metal with a low binder content, an ultrafine grain size and an optimum amount of Cr and Ta and/or Nb dissolved in the binder below or around the solubility limit within the binder.

Optionally, the cemented carbide comprises the Ta at 0.05 to 0.3 wt %; 0.1 to 0.2 wt %; 0.16 to 0.26 wt %; 0.12 to 0.16 wt % or 0.2 to 0.22 wt %. Optionally, the cemented carbide may comprise the Nb at 0.05 to 0.3 wt %; 0.1 to 0.2 wt %; 0.01 to 0.07 wt %; 0.02 to 0.06 wt %; 0.01 to 0.05 wt %; 0.02 to 0.06 wt % or 0.02 to 0.04 wt %. Optionally, the cemented carbide may comprise the Ta and the Nb in combination at 0.05 to 0.35 wt %; 0.1 to 0.3 wt %; 0.14 to 0.28 wt %; 0.16 to 0.2 wt % or; 0.2 to 0.28 wt %. The incorporation of such components is effective to improve hardness, wear resistance, corrosion resistance, strength and abrasion resistance.

Optionally, the wt %-quotient of Cr/Co is in the range 0.05 to 0.1; 0.05 to 0.09; 0.06 to 0.09; 0.06 to 0.08; 0.06 to 0.07; 0.07 to 0.1; 0.08 to 0.09. The Cr to Co ratio as described and claimed herein provides a hard metal with a low binder content, an ultra-fine grain size and desired solubility of grain refining components within the binder. In particular, precipitation of additional carbide phases (in addition to WC and binder phases) is avoided.

Optionally, V is included in the range 0.06 to 0.2 wt %; 0.08 to 0.2 wt %; 0.1 to 0.2 wt %; 0.12 to 0.18 wt % or 0.13 to 0.17 wt %. The addition of V is advantageous to enhance grain growth inhibition but minimise any embrittlement of the material.

Optionally, the cemented carbide may comprise the WC having a grain size in the range of 0.2 to 0.8 or 0.2 to 0.6 μm of sintered material as determined by linear intercept. Defined average grain sizes (in particular of the WC phases) provide the desired hardness, wear resistance, strength and abrasion resistance. Optionally, the present cemented carbide may comprise the WC at not less than 94 wt % or 95 wt %.

Optionally, the cemented carbide comprises two phases including a hard phase of WC and a binder phase; the cemented carbide further comprising Co at 3 to 5 wt %; Cr at 0.1 to 0.5 wt %; Ta and/or Nb present alone or in combination at 0.05 to 0.35 wt %; and V at 0.05 to 0.2 wt %. Preferably WC is included as balance.

Optionally, the cemented carbide consists of at least 93 wt % WC; Co at 3 to 5 wt %; Cr at 0.1 to 0.5 wt %; Ta and/or Nb present alone or in combination at 0.05 to 0.35 wt %; and V at 0.05 to 0.2 wt %.

Optionally, the cemented carbide may comprise a density in the range 14.5 to 15.5 g/cm$^3$; a Vickers hardness of HV30 of 1950 to 2150 or 2000 to 2100 and/or a Palmqvist fracture toughness of 8 to 9.5 MPa √m. Accordingly, the present grades comprise a high hardness to toughness relationship and minimised wear rates relative to comparative existing hard metal cemented carbide grades.

Optionally, there is provided a cemented carbide comprising a WC hard phase and a Co binder phase, the cemented carbide further comprising: at least 93 wt % WC; Co at 3 to 5 wt %; Cr at 0.1 to 0.5 wt %; Ta and/or Nb present alone or in combination at 0.05 to 0.35 wt %; and V at 0.05 to 0.2 wt %.

Optionally, the cemented carbide comprises WC as balance wt %. Preferably, the binder phase comprises Co, Cr, Ta and/or Nb, and V. Preferably Co, Cr, Ta and/or Nb and V are present in the Co-based binder phase in solid solution.

Preferably, the present cemented carbide comprises a binder phase content of less than 5 wt %, less than 4 wt %, less than 3 wt % or in a range 2 to 5 wt %, 2 to 4 wt %, 2 to 3 wt % based on a total weight of the cemented carbide.

Preferably, the present material is devoid of nitrides and/or carbon nitrides. Optionally, the cemented carbide may comprise nitrides and/or carbonitrides present at impurity levels. Preferably, the cemented carbide is devoid of Ti and carbides, nitrides and/or carbonitrides of Ti so as to be compositionally free of Ti.

In one aspect, the present cemented carbide may comprise: a balance of WC; Co at 3 to 5 wt %; Cr at 0.1 to 0.5 wt %; and Ta and/or Nb; wherein a wt %-quotient of Cr/Co is in a range 0.04 to 0.1. Optionally, such cemented carbide may comprise a WC hard phase and a Co based binder phase. Preferably, such a cemented carbide does not comprise a third phase such as a cubic carbide (gamma) phase.

Optionally, the present material may comprise impurities including elemental, carbide, nitride or carbonitride forms of Fe, Ti, Re, Ru, Zr, Al and/or Y. The impurity level is a level such as less than 0.1 wt %, less than 0.05 wt % or less than 0.01 wt % within the cemented carbide.

According to a further aspect of the present invention there is provided a metal wire drawing die comprising a cemented carbide as claimed herein.

There is also provided a method of making a cemented carbide article comprising: preparing a batch of powdered materials including WC at at least 93 wt %, Co at 3 to 5 wt %, Cr at 0.1 to 0.5 wt %, Ta and/or Nb alone or in combination at 0.05 to 0.35 wt %, and V at 0.05 to 0.2 wt %; pressing the batch of powdered materials to form a pre-form; and sintering the pre-form to form the article.

Optionally, the powder starting materials may be in their elemental form, carbide form, mixed carbide form or a combination thereof.

Optionally, the powdered starting materials are such that a wt %-quotient of Cr/Co is in a range 0.04 to 0.1.

Optionally, the step of sintering may comprise vacuum or HIP processing. Optionally, the step of sintering comprises processing at a temperature in the range 1360 to 1500° C. at a pressure in the range 0 to 20 MPa.

Optionally, the article or component manufactured from the present cemented carbide may be a metal wire drawing die. Optionally, the present cemented carbide may be formed as or a component of a cutting die, a material-deforming tool, a structural component, a mining bit, a press mold, a miniature drill for highly integrated printed circuit boards, a rock drill, a bearing, a mechanical seal or a wear part.

Optionally, the powdered material batch may comprise WC at not less than 93.94; Co at 3 to 5 wt %; $Cr_3C_2$ at 0.1 to 0.5 wt %; and 0.05 to 0.35 wt %; 0.1 to 0.3 wt %; 0.14 to 0.28 wt % or 0.16 to 0.26 wt % of any one of: i) TaC and NbC; ii) TaC without NbC or iii) NbC without TaC; and VC at 0.05 to 0.25 or 0.1 to 0.2 wt %.

BRIEF DESCRIPTION OF DRAWINGS

Specific implementations of the present disclosure will now be described with reference to the various examples and accompanying drawings in which.

DETAILED DESCRIPTION

Figure 1:
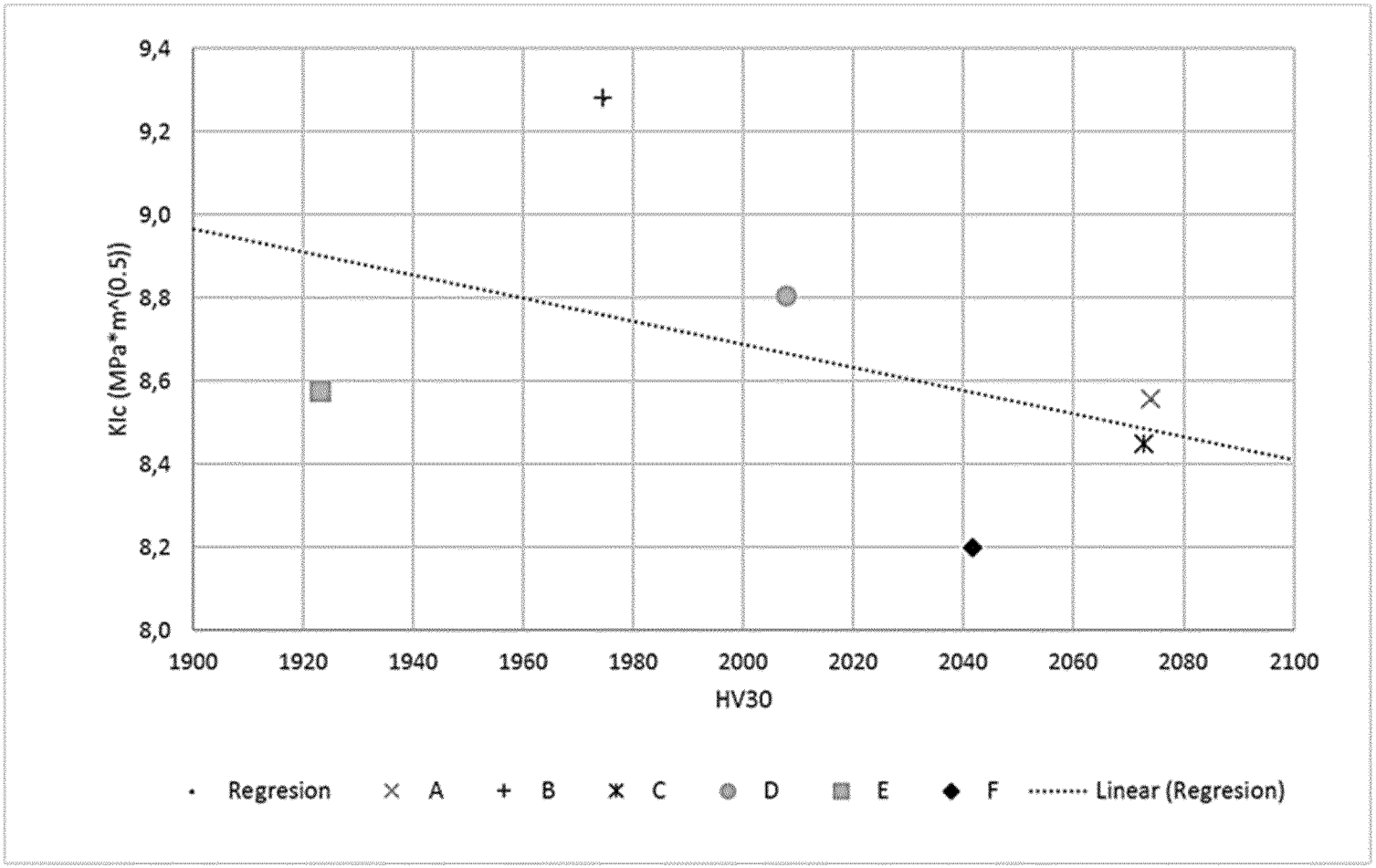
FIG. 1 is a graph of a hardness to toughness relationship for cemented carbide materials according to aspects of the present invention where the dotted line corresponds to a linear correlation.

A high performance hard metal cemented carbide material has been developed preferentially for metal wire drawing of high-tensile strength alloys. The present material is particularly adapted with high wear and corrosion resistance, high thermal conductivity, high hardness and in particular an enhanced hardness to fracture toughness correlation. Such characteristics are achieved by the selective control of grain size, binder content and composition. In particular, the present cemented carbide comprises an ultra-fine grain size, relatively low binder content and a corresponding enhanced binder-WC bonding strength.

EXAMPLES

Conventional powder metallurgical methods including milling, pressing, shaping and sintering were used to manufacture various sample grades of a cemented carbide according to the present invention. In particular, cemented carbide grades with wt % compositions according to Table 1 and 2 (elemental) were produced using known methods. Grades A to G were prepared from powders forming the hard constituents and powders forming the binder phase. Each of the sample mixtures Grades A to F were prepared from powders forming the hard constituents and powders forming the binder. The following preparation method corresponds to Grade A of Table 1 below having starting powdered materials: WC 93.08 g, Cr3C2 0.30 g, Co 3.92 g, NbC 0.03 g, TaC 0.16 g, VC 0.14 g, W 0.01 g, PEG 2.25 g, Ethanol 50 ml. It will be appreciated by those skilled in the art that it is the relative amounts of the powdered materials that allow the skilled person and suitable adjustment is needed to make the powdered batch and achieve the final fully sintered composition of the cemented carbides of Table 1. Accordingly, Table 1 lists the starting materials, with the exception of cobalt, in their carbide form. As will be appreciated, the respective carbide starting materials are used for convenience and cost from standard suppliers. In particular, TaC and NbC may be added as a mixed carbide starting material with their respective wt amounts indicated in Table 1.

Each of the sample mixtures were subjected to 8 h of ball milling using ethanol as liquid media and afterwards dried in a furnace (65° C.) and sieved. The powders were uniaxially pressed at 4 Tm. Green compacts were then deppeged at 450° C. and sintered in a SinterHIP at 1450° C. (70 min) in argon atmosphere (50 bar). PEG was introduced in all compositions.

TABLE 1

Example powdered starting material compositions A to D according to aspects of the present invention and comparative grades E and F.

| | Composition, wt % | | | | | |
|---|---|---|---|---|---|---|
| Grade | WC | NbC | Co | $Cr_3C_2$ | TaC | VC |
| A | 95.35 | 0.05 | 4.00 | 0.30 | 0.15 | 0.15 |
| B (comparative) | 94.24 | 0.03 | 5.00 | 0.50 | 0.23 | — |
| C (comparative) | 96.45 | 0.03 | 3.00 | 0.30 | 0.23 | — |
| D (comparative) | 95.34 | 0.03 | 4.00 | 0.40 | 0.23 | — |
| E (comparative) | 96.55 | — | 3.30 | — | — | 0.15 |
| F (comparative) | 92.90 | — | 6.20 | 0.30 | — | 0.60 |

TABLE 2 details the elemental compositions and ratios of the grades A to F.

| | Composition, wt % | | | | | | | | |
|---|---|---|---|---|---|---|---|---|---|
| Grade | Ta | Cr | V | Nb | W | Cr/Co | (Ta + Nb)/Cr | (Ta + Nb)/Co | Ta + Nb |
| A | 0.140 | 0.259 | 0.121 | 0.044 | 89.502 | 0.06499 | 0.711 | 0.046 | 0.184 |
| B (comparative) | 0.216 | 0.433 | — | 0.027 | 88.461 | 0.086657 | 0.559 | 0.048 | 0.243 |
| C (comparative) | 0.216 | 0.260 | — | 0.027 | 90.526 | 0.08666 | 0.932 | 0.081 | 0.242 |
| D (comparative) | 0.215 | 0.346 | — | 0.027 | 89.493 | 0.08665 | 0.698 | 0.060 | 0.242 |
| E(comparative) | — | — | 0.121 | — | 90.629 | — | — | — | |
| F (comparative) | — | 0.259 | 0.485 | — | 87.203 | 0.04193 | — | — | |

Characterisation

The various starting material powdered batches of Table 1 were processed to produce the final fully sintered materials. Characterisation of the sintered grades A to F was then undertaken including microstructural analysis using scanning electron microscopy (SEM) and energy dispersive X-Ray spectroscopy (EDS); hardness and toughness, sliding friction and wear testing and thermal conductivity.

Microstructure

Sintered samples were mounted in bakelite resin and polished down to 1 μm prior to further characterization. Microstructural analysis was carried out using scanning electron microscopy (SEM) and energy dispersive X-ray spectroscopy (EDS). The polished samples were etched with Murakami etchant to reveal the microstructure and, according to the ATM 4499-1:2010, the linear intercept technique was used for measuring the WC grain size.

The linear intercept method (ISO 4499-2:2008) is a method of measurement of WC grain size. Grain-size measurements are obtained from SEM images of the microstructure. For a nominally two-phase material such as a cemented carbide (hard phase and binder phase), the linear-intercept technique gives information of the grain-size distribution. A line is drawn across a calibrated image of the microstructure of the cemented carbide. Where this line intercepts a grain of WC, the length of the line ($l_i$) is measured using a calibrated rule (where i=1, 2, 3, . . . n for the first $1^{st}$, $2^{nd}$, $3^{rd}$, . . . , nth grain). At least 100 grains where counted for the measurements. The average WC grain size will be defined as:

$$d_{WC} = \sum l_i / n$$

Hardness and Toughness

Vickers indentation test was performed using 30 kgf (HV30) to assess hardness. Palmqvist fracture toughness was calculated according to:

$$K1c = A\sqrt{HV}\sqrt{\frac{P}{\sum L}}$$

where A is a constant of 0.0028, H is the hardness ($N/mm^2$), P is the applied load (N) and ΣL is the sum of crack lengths (mm) of the imprints.

Sliding Friction and Wear Test

The methodology used to assess wear behavior was:

Sintered samples were mounted in bakelite resin and polished down to 1 μm.

Samples were afterwards dismounted from the bakelite and placed in a circular geometry holder designed for Wazau wear tester.

The Wazau wear tester in the linear reciprocating module was used according to ASTM G133. Al2O3 balls of Ø10 mm were used for characterizing abrasive wear. Conditions used were: load=150N, speed=250 rpm, stroke length=10 mm, sample frequency=100 Hz (for 1 h test). Samples were immersed in lubricant while testing to simulate the real process.

During each wear experiment the imposed normal contact force (FN) and the concomitant tangential friction force (FT) of pin-on-flat sliding pairs were continuously registered. The coefficient of friction (0 is calculated from the FT/FN forces ratio.

After the test, the wear damage pattern was evaluated by SEM analysis and the thickness of the wear track measured.

Thermal Conductivity

The specific heat and thermal diffusivity were evaluated at five different temperatures (30, 100, 200, 300, 400 and 500° C.) by CIC Energigune technological centre. The thermal conductivity was calculated from the density and thermal diffusivity measurements according to the formula:

$$\lambda(T) = \rho(T) * Cp(T) * a(T)$$

With:

λ—Thermal Conductivity

ρ—Density (determined by picnometry)

Cp—Specific Heat

α—Thermal Diffusivity

T—Temperature

In order to determine the specific heat (Cp), a DSC calorimeter (Differencial Scanning calorimetry) DSC Discovery 2500 equipment was used. The thermal diffusivity was measured using the NETZSCH laser flash apparatus LFA 457 MicroFlash®. The LFA 457 calculates thermal diffusivity using the "Parker Equation"

$$\alpha = 0.1388 * \frac{L^2}{t0.5^2}$$

With:

L=sample thickness (mm)

t0.5=time at the 50% of temperature increase (s)

Results

Referring to tables 1 and 2, the present hard metal grades combine Co content between 3 wt % and 5 wt %, and optimum additions of VC, $Cr_3C_2$, NbC and TaC as grain growth inhibitors. FIG. 1 shows the HV30 to Palmqvist toughness relations for the developed grades A to D as compared to the reference grades E and F. As it can be seen, the proposed materials exhibit better hardness to toughness levels than reference grades E and F. This is probably related to the replacement of VC as GGI by higher quantities of other elements (with further benefits) such as Cr, Ta and Nb. The values of HV30 and toughness are shown in table 3.

TABLE 3

| Composition, wt % | HV30 | KIc (MPa × $m^{0.5}$) |
|---|---|---|
| A | 2074 | 8.6 |
| B comparative | 1975 | 9.3 |
| C comparative | 2073 | 8.4 |
| D comparative | 2008 | 8.8 |
| E comparative | 1923 | 8.6 |
| F comparative | 2042 | 8.2 |

Hardness and toughness values for present grade A and comparatives B to F

Figure 2:
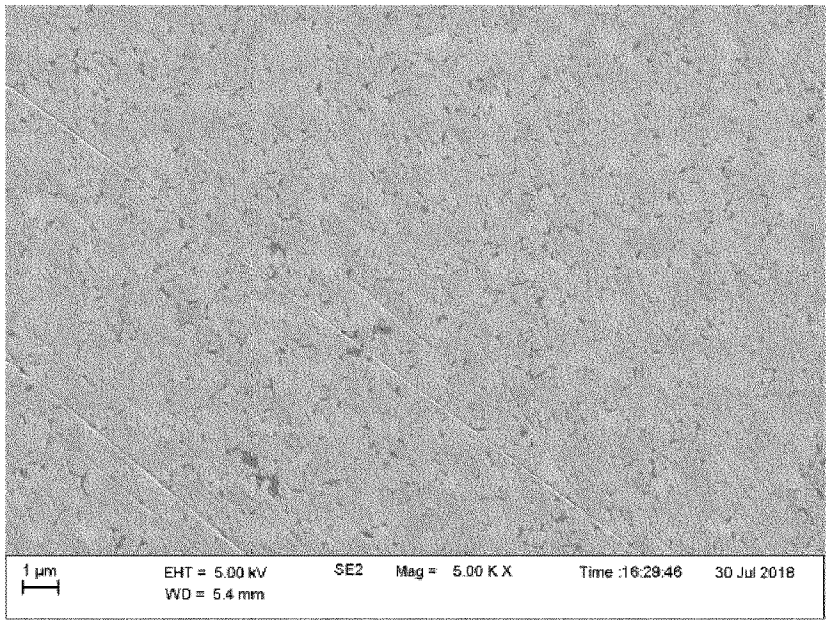
FIG. 2 are micrographs of a hard metal grade A at: (a) 2000× magnifications and (b) 5000× magnifications.
Figure 3:
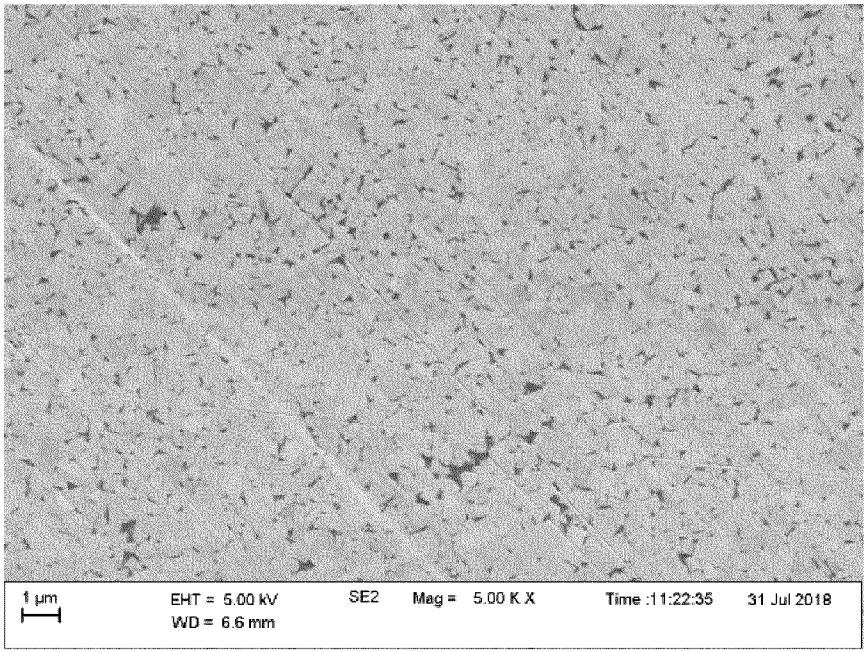
FIG. 3 are micrographs of a hard metal grade B at: (a) 2000× magnifications and (b) 5000× magnifications.
Figure 3:
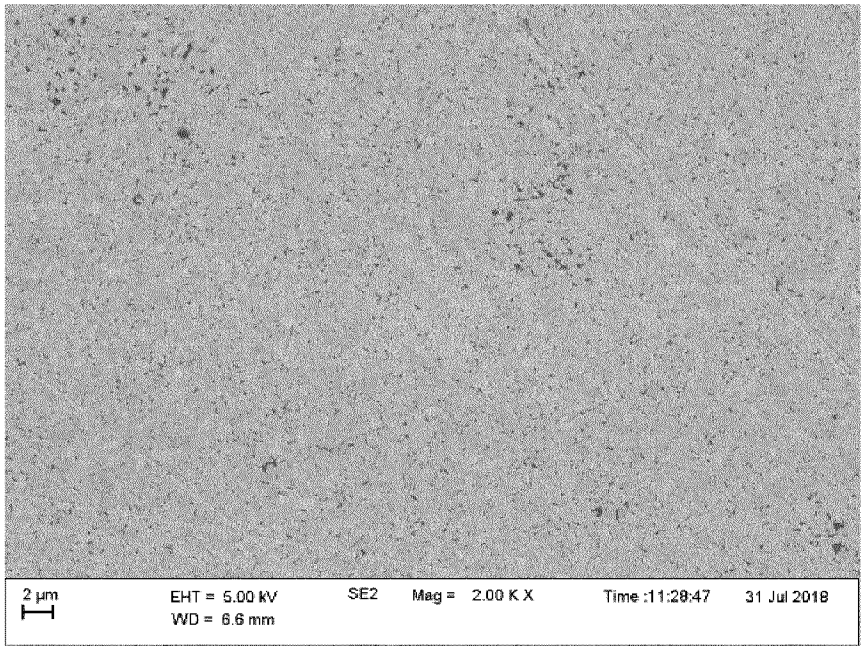
Figure 4:
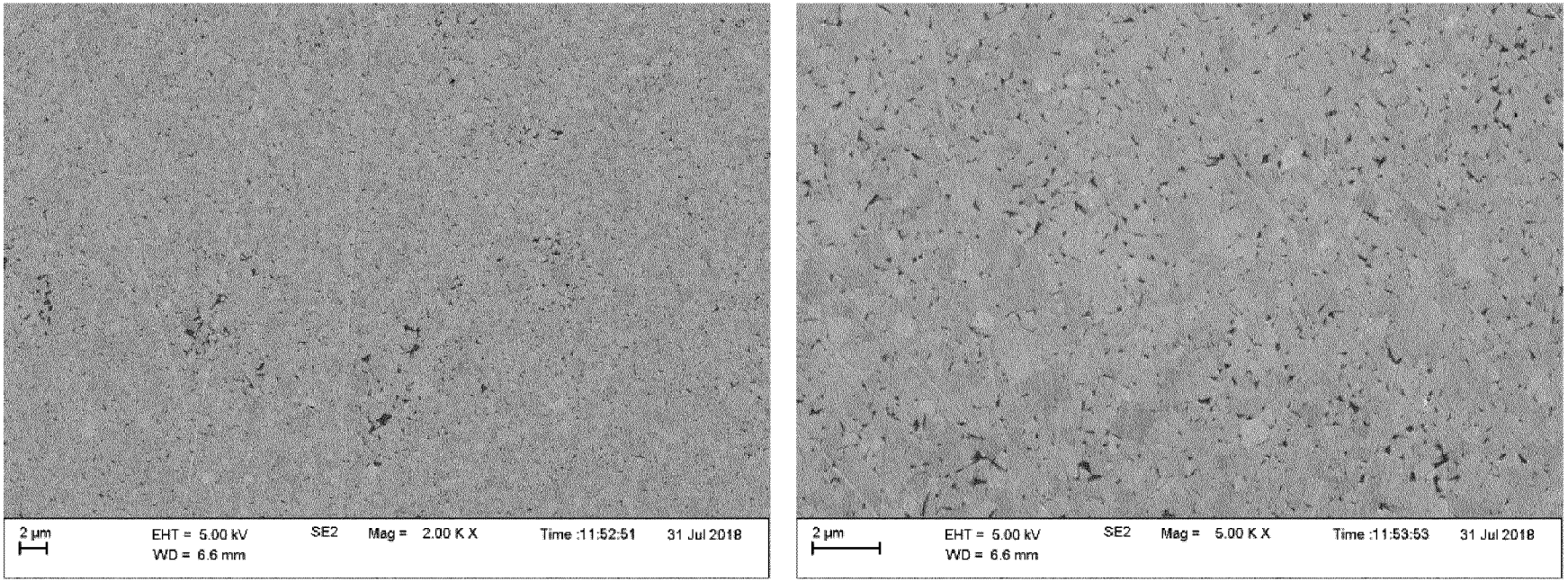
FIG. 4 are micrographs of a hard metal grade C at: (a) 2000× magnifications and (b) 5000× magnifications.
Figure 5:
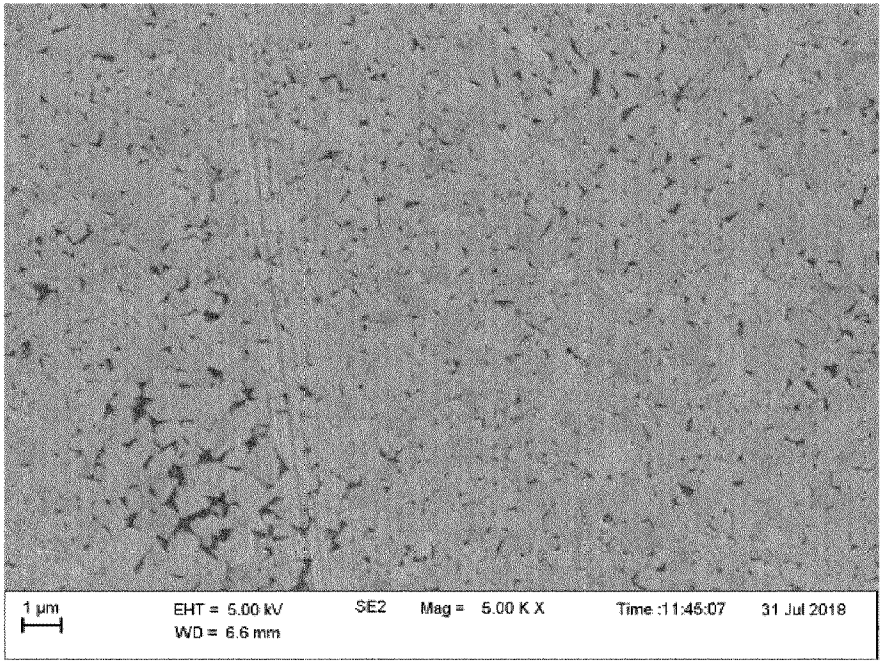
FIG. 5 are micrographs of a hard metal grade D at: (a) 2000× magnifications and (b) 5000× magnifications.
Figure 5:
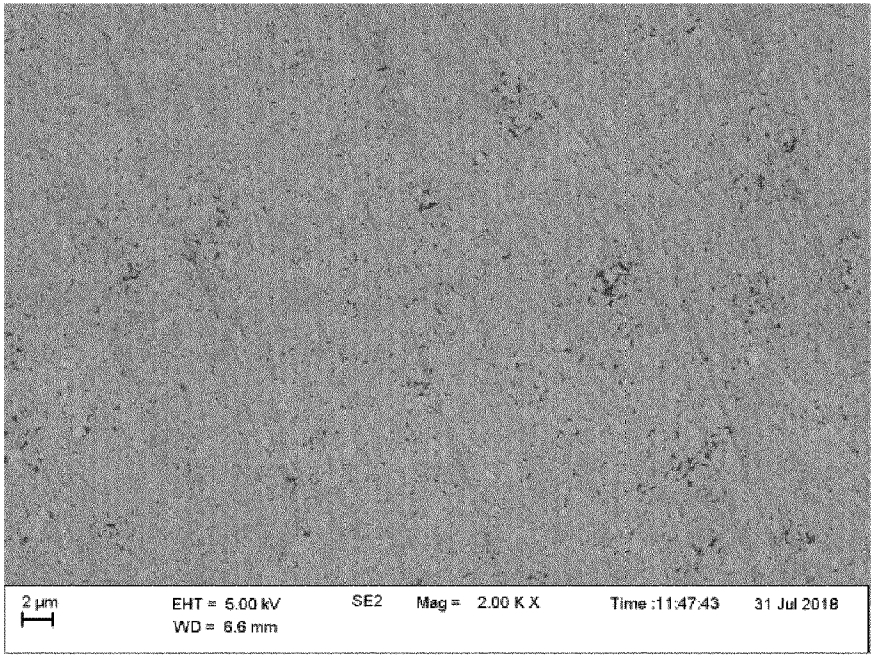
Figure 6:
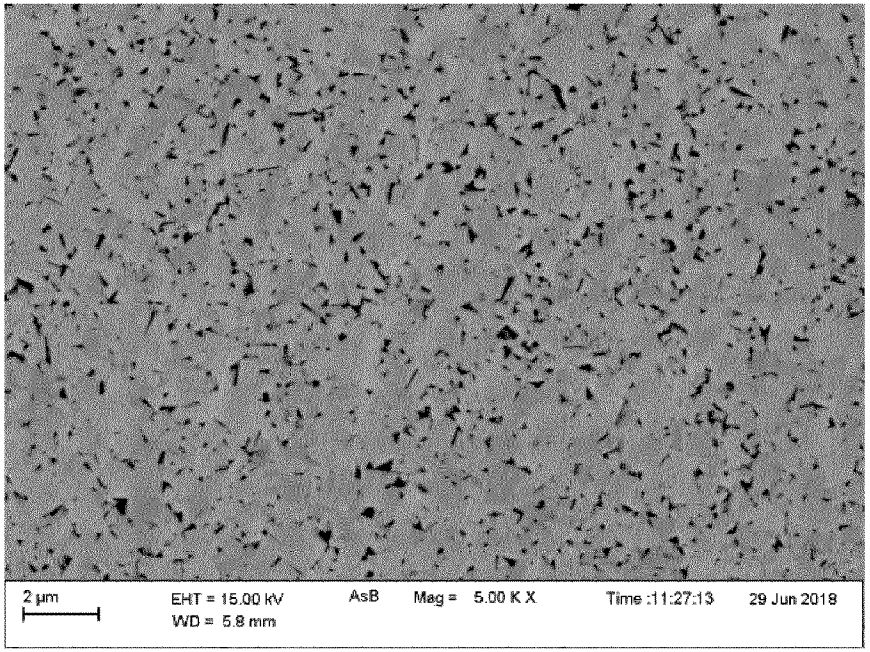
FIG. 6 are micrographs of a hard metal grade E at: (a) 2000× magnifications and (b) 5000× magnifications.
Figure 6:
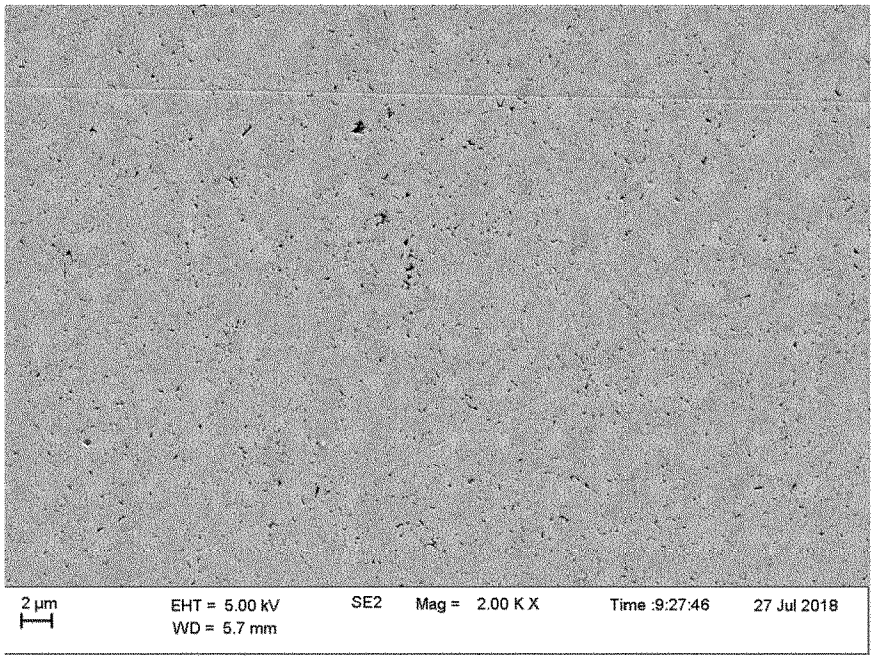
Figure 7:
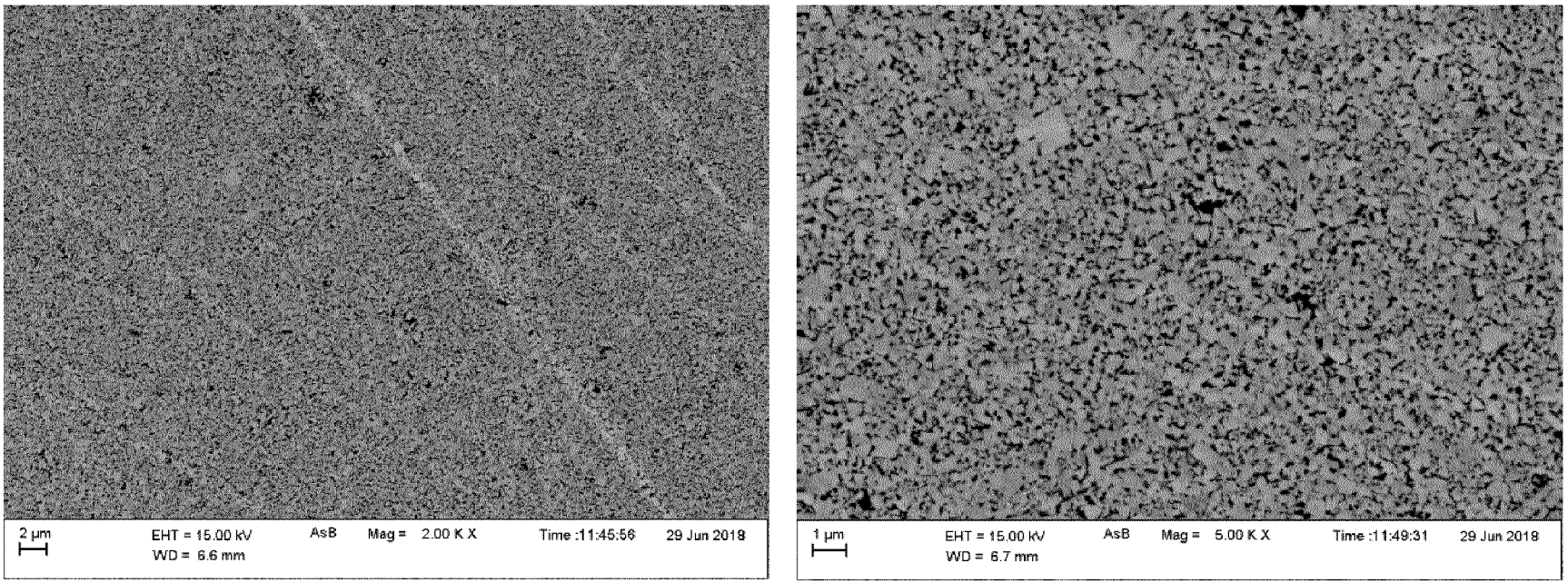
FIG. 7 are micrographs of a hard metal grade F at: (a) 2000× magnifications and (b) 5000× magnifications.

The microstructures of the reference and developed hard metal grades are shown at 2000× and 5000× from FIG. 2 to FIG. 7. FIG. 2 are micrographs of hard metal grade A at: (a) 2000× magnifications and (b) 5000× magnifications. FIG. 3 are micrographs of hard metal comparative grade B at: (a) 2000× magnifications and (b) 5000× magnifications. FIG. 4 are micrographs of hard metal comparative grade C at: (a) 2000× magnifications and (b) 5000× magnifications. FIG. 5 are micrographs of hard metal comparative grade D at: (a) 2000× magnifications and (b) 5000× magnifications. FIG. 6 are micrographs of hard metal comparative grade E at: (a) 2000× magnifications and (b) 5000× magnifications. FIG. 7 are micrographs of hard metal comparative grade F at: (a) 2000× magnifications and (b) 5000× magnifications.

Wear Response

Figure 8:
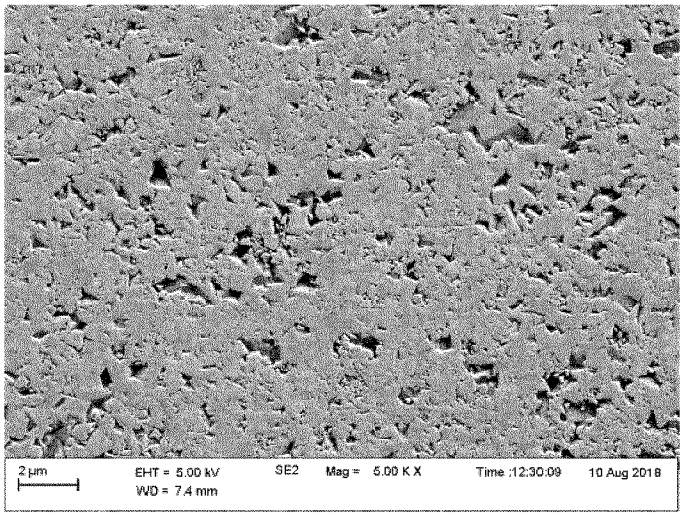
FIG. 8 are SEM images of worn surfaces of various sample grades according to aspects of the present invention after sliding wear testing.
Figure 8:
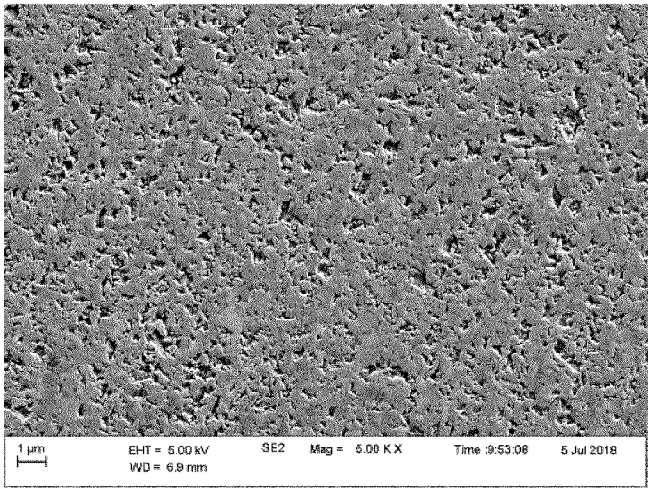
Figure 8:
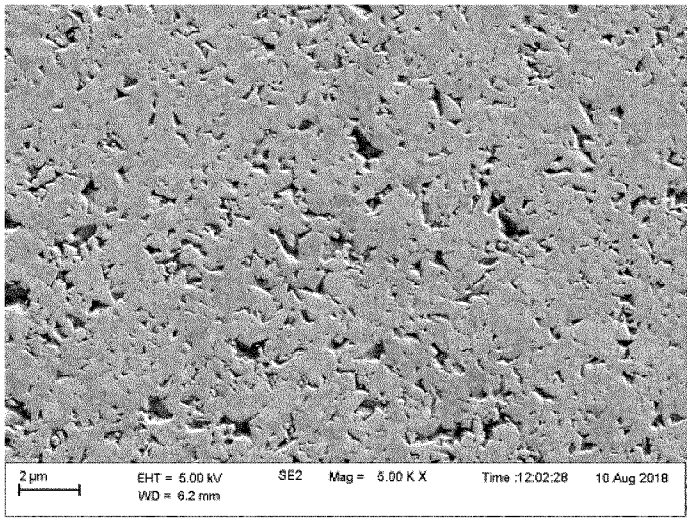
Figure 8:
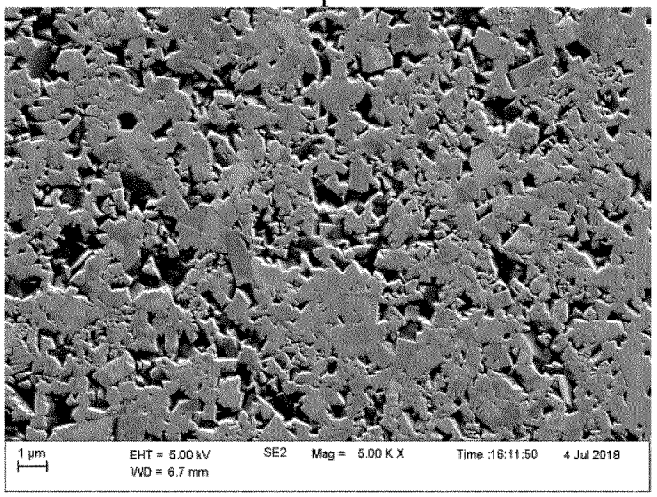
Figure 9:
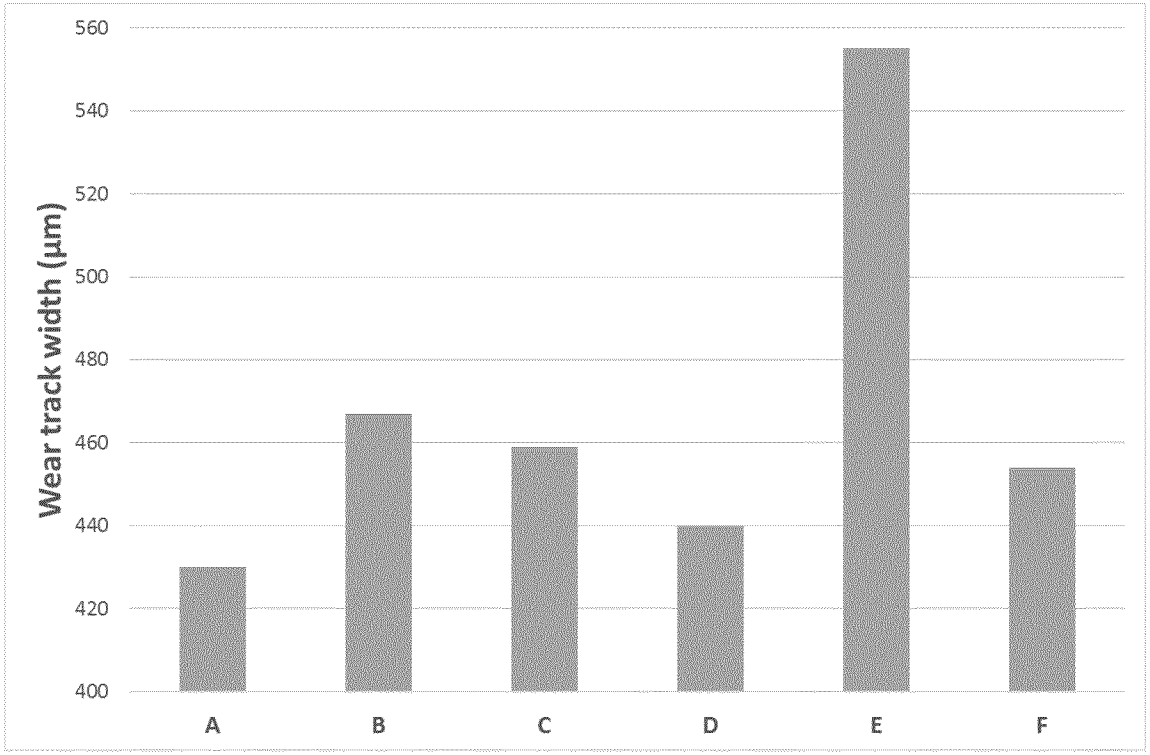
FIG. 9 is a graph of wear track width of various sample grades after testing as measured by SEM analysis.

The wear damage in terms of abrasion was evaluated by using $Al_2O_3$ balls. As it can be seen in FIG. 8, the wear tracks revealed that all samples underwent the same wear mechanism based on grain pull out due to abrasive effect of the hard counterpart. Despite these similarities in the mechanism, reference sample E suffered more wear than the rest due to its lower hardness. In addition, sample E does not contain any Ta, Nb and Cr, but only VC as a grain refiner, which was found to embrittle the material. These observations are in full agreement with wear track width measurements shown in FIG. 9.

Thermal Conductivity

Figure 10:
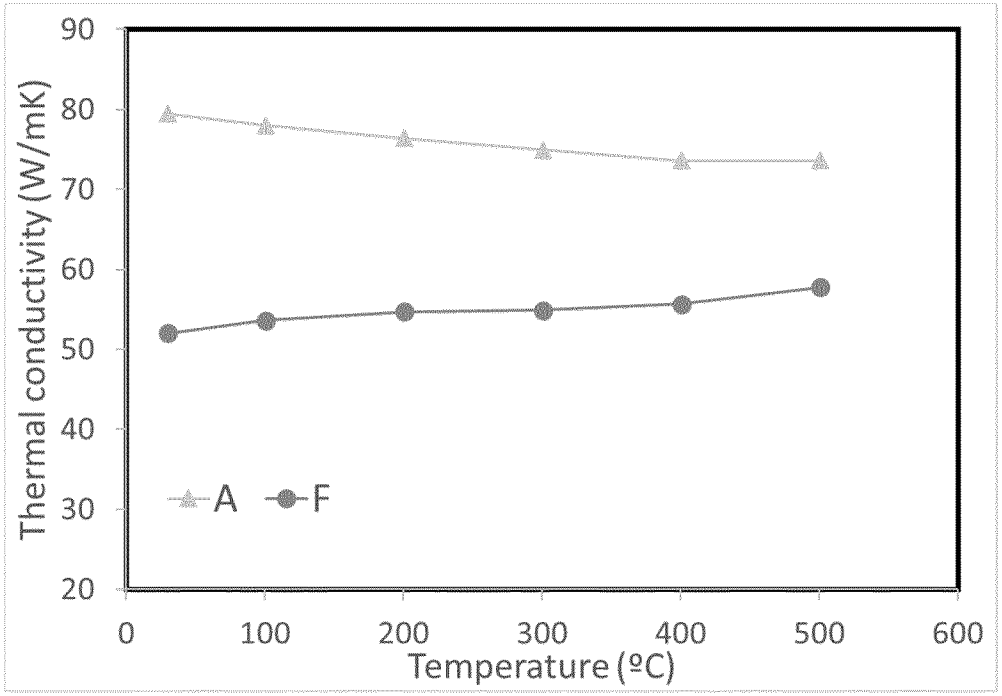
FIG. 10 is a graph of thermal conductivity of sample grade A and a reference sample grade F.

The thermal conductivity of standard WC/Co hard metals is about twice as high as that of high-speed steel. Both, thermal conductivity and thermal expansion can be tailored by changing the volume fraction of binder phase and the grain size of hard carbide phase. High thermal conductivity is a key property in wire drawing applications to dissipate heat along the tool and avoid premature failure due to properties degradation at high temperatures and thermal damage. FIG. 10 compares thermal conductivity of sample A to the reference sample F from room temperature up to 500° C. As it can be seen from the FIG. 10, since this property is very sensitive to grain size, F presents lower values of thermal conductivity. The presence of VC (a powerful grain refiner) in a larger amount as compared to grade A, renders this material less thermally conductive due to its finer grain size. In addition to this, the Co content in grade F is larger than in grade A, a fact that further contributes to its lower thermal conductivity.

Unless defined otherwise all technical and scientific terms used herein have the same meaning as commonly understood to one of ordinary skill in the art to which the presently described subject matter pertains.

Unless otherwise indicated, any reference to "wt %" refers to the mass fraction of the component relative to the total mass of the cemented carbide.

Where a range of values is provided, for example, concentration ranges, percentage range or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

It should be understood that the terms "a" and "an" as used above and elsewhere herein refer to "one or more" of the enumerated components. It will be clear to one of ordinary skill in the art that the use of the singular includes the plural unless specifically stated otherwise. Therefore, the terms "a", "an" and "at least one" are used interchangeably in this application.

Unless otherwise indicated, all numbers expressing quantities of ingredients, properties such as size, weight, reaction conditions and so forth used in the specification and claims are to be understood as being modified in all instances by the term "about". Accordingly, unless indicated to the contrary, the numerical parameters set forth in the following specification and attached claims are approximations that may vary depending upon the desired properties sought to be obtained by the present subject matter. At the very least, and not as an attempt to limit the application of the doctrine of equivalents to the scope of the claims, each numerical parameter should at least be construed in light of the number of reported significant digits and by applying ordinary rounding techniques.

Throughout the application, descriptions of various embodiments use "comprising" language; however, it will be understood by one of skill in the art that, in some instances, an embodiment can alternatively be described using the language "consisting essentially of" or "consisting of".

The present subject matter being thus described, it will be apparent that the same may be modified or varied in many ways. Such modifications and variations are not to be regarded as a departure from the spirit and scope of the present subject matter, and all such modifications and variations are intended to be included within the scope of the following claims.

The invention claimed is:

1. A cemented carbide, comprising:

at least 95 wt. % WC;

Co present in an amount from 3 to 4 wt. %;

Cr present in an amount from 0.10 to 0.50 wt. % and a wt. %-quotient of Cr/Co is in a range from 0.06 to 0.07;

Ta present in an amount from 0.05 to 0.30 wt. %;

Nb present in an amount from 0.01 to 0.07 wt. %; and

V present in an amount from 0.05 to 0.20 wt. %, wherein an impurity including any one of Fe, Ru, or Y is present in the cemented carbide, and wherein the cemented carbide has a Vickers hardness HV30 from 1950 to 2150 measured by using 30 kgf (HV30) and a Palmqvist fracture toughness ($K_{Ic}$) from 8.0 to 9.5 MPa √m calculated according to $$K1c = A\sqrt{HV}\sqrt{\frac{P}{\sum L}},$$

where A is a constant of 0.0028, HV is hardness (N/mm$^2$), P is applied load (N), and ΣL is sum of crack lengths (mm) of imprints.

2. The cemented carbide according to claim 1, wherein the Nb is present in an amount from 0.02 to 0.06 wt. %.

3. The cemented carbide according to claim 1, wherein the WC has a grain size in a range from 0.2 to 0.8 μm.

4. The cemented carbide according to claim 3, wherein the grain size is in the range from 0.2 to 0.6 μm.

5. The cemented carbide according to claim 1, comprising a density in a range from 14.5 to 15.5 g/cm$^3$.

6. A metal wire drawing die, comprising the cemented carbide according to claim 1.

7. A cemented carbide, comprising:

at least 95 wt. % WC;

Co present in an amount from 3 to 4 wt. %;

Cr present in an amount from 0.10 to 0.50 wt. % and a wt. %-quotient of Cr/Co is in a range from 0.06 to 0.07;

Ta present in an amount from 0.05 to 0.30 wt. %;

Nb present in an amount from 0.01 to 0.07 wt. %; and

V present in an amount from 0.05 to 0.20 wt. %, wherein an impurity including any one of Fe, Ru, or Y is present in the cemented carbide, and wherein the cemented carbide is an etched cemented carbide with a Murakami etchant to measure a grain size of the WC, which is in a range from 0.2 to 0.8 μm.

8. A cemented carbide, consisting of:

at least 95 wt. % WC;

Co present in an amount from 3 to 4 wt. %;

Cr present in an amount from 0.10 to 0.50 wt. % and a wt. %-quotient of Cr/Co is in a range from 0.06 to 0.07;

Ta present in an amount from 0.05 to 0.30 wt. %;

Nb present in an amount from 0.01 to 0.07 wt. %; and

V present in an amount from 0.05 to 0.20 wt. %, wherein an impurity including any one of Fe, Ru, or Y is present in the cemented carbide, and wherein the cemented carbide has a Vickers hardness HV30 from 1950 to 2150 measured by using 30 kgf (HV30) and a Palmqvist fracture toughness ($K_{Ic}$) from 8.0 to 9.5 MPa √m calculated according to $$K1c = A\sqrt{HV}\sqrt{\frac{P}{\sum L}},$$

where A is a constant of 0.0028, HV is hardness ($N/mm^2$), P is applied load (N), and ΣL is sum of crack lengths (mm) of imprints.

* * * * *